United States Patent [19]

Marx et al.

[11] Patent Number: 4,651,476

[45] Date of Patent: Mar. 24, 1987

[54] COMPACT RECEPTACLE WITH AUTOMATIC FEED FOR DISSIPATING A HIGH-VELOCITY FLUID JET

[75] Inventors: Emil A. Marx; Bruce L. Amundsen, both of Kent; Curtis L. Anderson, Puyallup; Glenn A. Erichsen, Everett; Timothy D. Wood, Puyallup, all of Wash.

[73] Assignee: Flow Systems, Inc., Kent, Wash.

[21] Appl. No.: 861,237

[22] Filed: May 7, 1986

[51] Int. Cl.[4] ..... B24C 9/00

[52] U.S. Cl. ..... 51/410; 51/270; 51/321; 83/53; 83/177

[58] Field of Search ..... 51/319, 320, 321, 270, 51/274, 410, 424; 83/53, 177; 181/208, 288

[56] References Cited

U.S. PATENT DOCUMENTS

| | | | |
|---|---|---|---|
| 2,985,050 | 5/1961 | Schwacha | 83/177 X |
| 3,212,378 | 10/1965 | Rice | 51/321 X |
| 3,978,748 | 9/1976 | Leslie et al. | 83/53 |
| 4,501,182 | 2/1985 | Jardat et al. | 83/177 |

*Primary Examiner*—Robert P. Olszewski
*Attorney, Agent, or Firm*—Romney Golant Martin Seldon & Ashen

[57] ABSTRACT

An energy-dissipating receptacle is disclosed for use with fluid jet cutting systems. The receptacle includes a volume of suspensoids which circulate within the cavity to at least substantially dissipate the kinetic energy of the fluid jet, together with means for automatically maintaining an effective volume of suspensoids in the cavity as the suspensoid volume is decreased by the wearing action of the fluid jet impingement.

The effective volume of suspensoids are preferably maintained by means of a filler tube having a discharge end positioned within the receptacle to effectively regulate the suspensoid volume.

By including means for maintaining an effective volume of suspensoids during the cutting process, the receptacle may be fabricated with compact dimensions for enhanced maneuverability when coupled to a fluid jet nozzle for coordinated movement therewith.

11 Claims, 3 Drawing Figures

FIG. 1
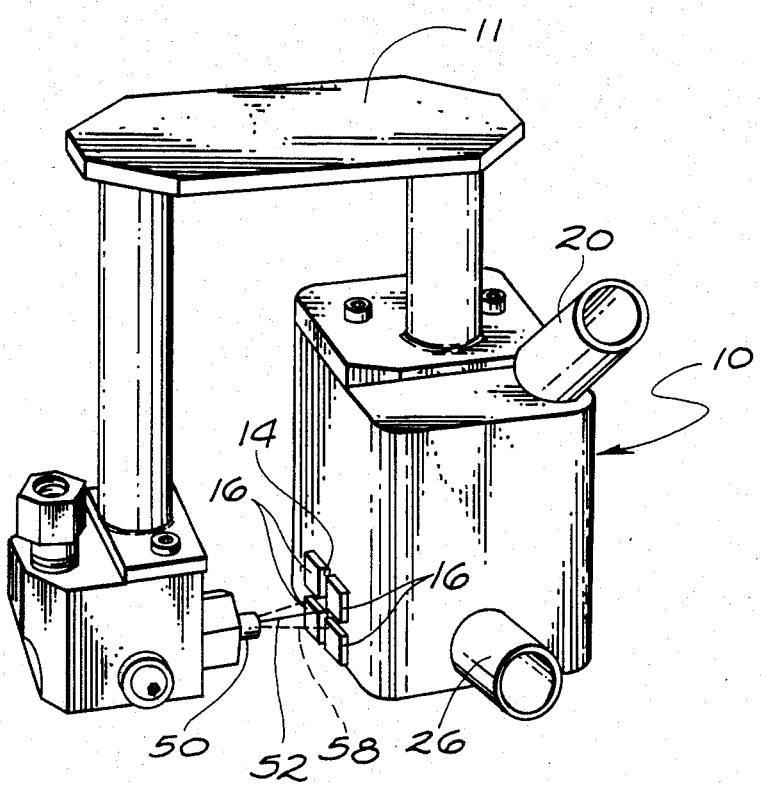
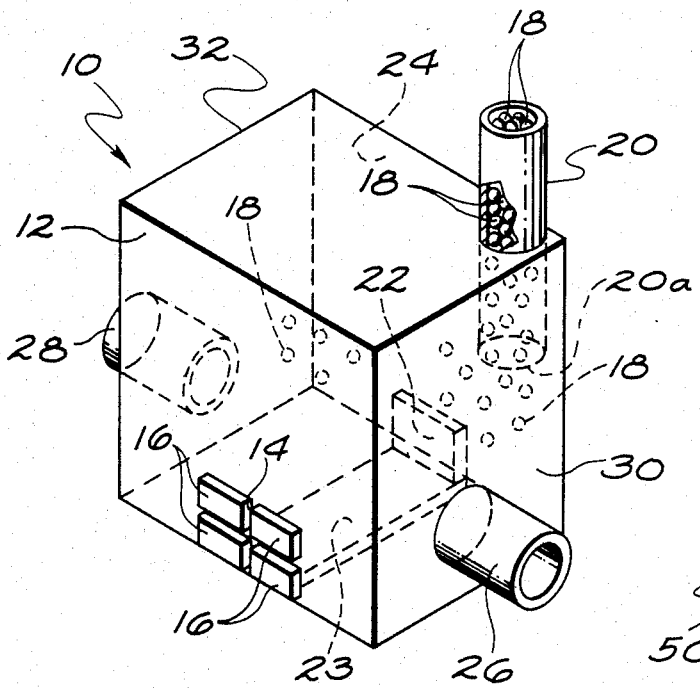
FIG. 2
FIG. 3
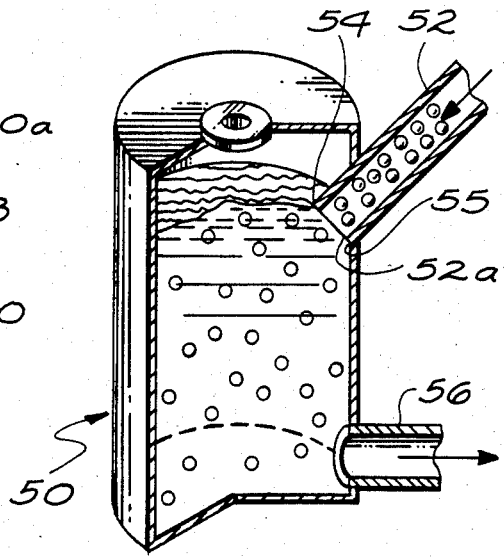

COMPACT RECEPTACLE WITH AUTOMATIC FEED FOR DISSIPATING A HIGH-VELOCITY FLUID JET

This invention relates to fluid jet cutting systems, and more specifically, to the energy-dissipating receptacle associated with such systems.

Cutting by means of a high velocity fluid jet is well known in the art. Typically, a fluid, such as water, at a pressure of 55,000 pounds per square inch is forced through a jewel nozzle having a diameter of 0.003 to 0.030 inches to generate a jet having a velocity of up to three times the speed of sound. The jet thus produced can be used to cut through a variety of metallic and non-metallic materials such as steel, aluminum, paper, rubber, plastics, Kevlar, graphite and food products.

To enhance the cutting power of the fluid jet, abrasive materials have been added to the jet stream to produce a socalled "abrasive jet". The abrasive jet is used to effectively cut a wide variety of materials from exceptionally hard materials such as tool steel, armor plate, certain ceramics and bullet-proof glass to soft materials such as lead. Typical abrasive materials include garnet, silica and aluminum oxide having grit sizes of #36 through #120. As used herein, the term "fluid jet" is used generically to mean fluid jets with and without the addition of abrasives.

The high energy of a fluid jet must somehow be absorbed once it is passed through the workpiece. Not only is the jet a danger to persons or equipment which might accidentally be impinged, but the fluid forming the jet must also be collected for proper disposal.

Accordingly, fluid jet cutting systems have included an energy-dissipating receptacle for receiving the high velocity jet of fluid. For example, U.S. Pat. Nos. 2,985,050 and 3,212,378 disclose a catch tank containing water or other fluid above a resilient pad of rubber or neoprene or other elastomeric material. Spray rails are provided on each side of the tank with a waterspray being directed downwardly over the liquid surface to blanket the vapors of the cutting fluid and prevent their disbursal in the area of the cutting machine.

U.S. Pat. No. 3,730,040 discloses an energy-absorbing receptacle containing a hardened steel impact block at the bottom of the receptacle, and a frusto-conical baffle arrangement immediately adjacent the workpiece at the top of the receptacle. The jet passes into the receptacle, through a liquid in the receptacle which absorbs a portion of the jet's energy. The jet thereafter impacts the steel block at the bottom of the receptacle. The orientation of the baffle plates are described as preventing sound, spray and vapor from passing back out of the entrance.

Energy-dissipating receptacles, or catchers, which are known in the art suffer from two basic problems. First, conventional catchers, particularly those used with abrasive jets, have experienced excessive wear and have required relatively expensive wear components. Owing to the cutting force of the jet, these components have still experienced relatively short useful lives.

Secondly, the catcher housing has heretofore been large and expensive owing to both the quality and quantity of the metal from which it is fabricated. Thick metallic walls have been required to ensure against penetration by the fluid jet, particularly where abrasive jets are utilized. Additionally, the conventional catcher body has been relatively long in the direction of jet flow in order to provide sufficient energy-dissipating path through the interior of the receptacle. For example, conventional catchers have typically been up to 36 inches long in the direction of jet travel.

It is highly desirable to utilize a catcher having compact dimensions for a number of reasons. In some applications, the catcher is coupled to the nozzle for coordinated movement with respect to the workpiece. A catcher having compact dimensions requires less clearance between obstructions and is therefore more maneuverable in such applications. Additionally, a compact catcher has less mass, and is therefore more amenable to use with hand-held fluid jet cutting apparatus wherein the nozzle and catcher are moved mutually during the cutting process.

Accordingly, the present invention is directed to a method and apparatus for dissipating the energy of a high-velocity jet of fluid within a compact receptacle. The energy-dissipating receptacle comprises a body having an internal cavity and an aperture for receiving a high velocity jet of fluid. The cavity is occupied by a volume of suspensoids which circulate within the cavity in response to the impact of the fluid jet. As the fluid jet penetrates the volume of suspensoids, and at least some of them become suspended within the dissipated fluid, the suspensoids absorb at least a substantial amount of the energy of the impinging jet. At the jet-related wear of the suspensoids reduces their cross section and, accordingly, the effective suspensoid volume, fresh suspensoids are fed into the cavity by such means as an insert tube, the discharge end of which is extending into the suspensoid volume where an insufficient suspensoid volume creates one or more suspensoid-accommodating spaces in the circulating volume.

The receptacle additionally includes means for permitting the egress of dissipated fluid and suspensoid waste from the cavity, while retaining the suspensoids therein.

These and other details concerning the invention will be apparent in the following description of the preferred embodiment, of which the following drawing is a part.

BRIEF DESCRIPTION OF THE DRAWINGS

FIG. 1 is a perspective view of an energy-dissipating receptacle constructed in accordance with the invention; mounted on a fluid jet nozzle for movement therewith;

FIG. 2 is a perspective view, in schematic illustration showing the external and internal components of an energy-dissipating receptacle constructed in accordance with the invention; and FIG. 3 is a cross sectional view, in schematic, of another embodiment of an energy-dissipating receptacle constructed in accordance with the invention.

DESCRIPTION OF THE PREFERRED EMBODIMENT

Referring initially to FIG. 1, a fluid jet cutting system is illustrated comprising a nozzle 50 for producing a high velocity jet of fluid 52. Typically, the fluid is water, or a water/abrasive mixture. The fluid is forced at a pressure of approximately 30,000–55,000 lbs. per sq. in. through a jewel nozzle having a diameter of 0.076 mms to 0.76 mms (0.003 to 0.030 inches), producing a jet having a velocity of up to three times the speed of sound.

An energy-dissipating receptacle 10 is coupled to the nozzle 50 by means 11 for movement therewith. The jet 52 is directed horizontally against a sheet of material (not shown) interjacent the nozzle 50 and receptacle 10 so that the material is penetrated by the jet 52. The nozzle 50 and receptacle 10 are moved relative to the material, with the cut being made in the direction of nozzle movement or in the direction opposite to the movement of the material, as the case may be.

During the cutting process, the jet 52 passes through the material and enters the entry-dissipating receptacle 10. In practice, the jet may be deflected by the material, with the deflection being in the direction opposite to the direction of cut. The path of a deflected jet emerging from the material is accordingly respresented schematically in FIG. 1 as a dotted line 58. The energy-dissipating receptacle 10 is adapted to receive the jet once it has passed through the workpiece so that the jet's kinetic energy can be absorbed.

FIG. 2 schematically illustrates an energy-dissipating receptacle 10 constructed in accordance with the invention with its internal components illustrated in dotted lines. The receptacle 10 comprises a small stainless steel box approximately 10.16 cm (4 inches) wide, 10.16 cm (4 inches) high, and 7.6 cm (3 inches) deep. A cross-shaped, jet-receiving slot 14 is formed at the bottom of the front face 12 approximately midway across its width. The slot 14 is disposed between 4 carbide blocks 16 which are affixed to the exterior of the receptacle by such means as silver-soldering. The slot 14 is cross-shaped to accommodate varying degrees of jet deflection as cuts are made in either the horizontal or vertical directions. The height and width of the slot is slightly greater than 2.54 cm (1 inch).

The formation of the slot 14 may be deferred until after the receptacle 10 has been installed in the field. Upon installation, the fluid jet is permitted to impinge upon and cut the stainless steel material exposed between the carbide blocks. The harder carbide blocks protect the underlying stainless steel material from impact and cutting action.

The interior of the receptacle 10 is filled to a height of 8.9 cm (3½ inches) with steel balls having a diameter of 6.35 mm (0.25 inches). For clarity, the balls 18 are only symbolically represented in FIG. 2. To prevent the balls from rusting and adhering to each other, stainless steel is preferred.

A stainless steel inlet tube 20, 2.54 cm (one inch) in diameter, extends through the top rear corner of the receptacle 10. The discharge end **20*a* of the insert tube 20 extends 3.8 cm (1.50 inches) into the volume of balls 18. The insert tube 20** is filled with balls which, as described below, replenish the volume of balls inside the receptacle during the cutting process.

A first carbide block 22, approximately 4.45 cm (1.75 inches) on each side, is affixed to the interior back wall 24 of the receptacle 10 directly behind the slot 14. A pair of outlet tubes 26, 28 extend through opposite sidewalls 30, 32 of the receptacle 10. A vacuum of 4980–5478 Pa. (20–22 in. of water) is conveniently drawn through the outlet tubes by a vacuum pump (not shown). A second carbide block 23 approximately 25.4 mm (1 inch) wide by 1.6 mm (0.0625 inches) thick, is affixed to the bottom of the receptacle cavity and extends the full depth of the receptacle from the slot 14 to the first block 22.

In operation, the jet 52 enters the receptacle 10 through the slots 14 and encounters the steel balls 18, causing a circulatory motion of the balls. By their motion, the balls absorb a substantial amount of the jet's kinetic energy, with any remaining jet stream energy being dissipated against the carbide block 22. When an upwardly directed cut is made, causing a sharply downwardly deflected jet to enter the receptacle, the lower carbide block 23 serves to dissipate the remaining energy of any portion of the jet hitting the surface of the cavity.

The dissipated fluid from the incoming jet is withdrawn via the outlet tubes 26, 28 at a rate which permits some accumulation of fluid within the receptacle 10. As the balls 18 are impinged, they suffer abrasive wear and are, themselves, worn down. When their size decreases below the useful minimum, they are allowed to pass outward through the outlets tubes 26, 28 by means of any suitable filter, such as a screen (not shown), which retains the remaining balls within the receptacle 10.

The inlet tube 20 allows automatic feeding of new balls into the receptacle to replace those worn out by the abrasive jet. The replenishment process is generally self regulating. As the balls 18 become worn and their volume decreases, balls are drawn from the discharge end **20*a* of tube 20 into the circulating volume of balls. Although the specific reason for the self regulating process is not fully understood, it appears that an insufficient quantity of circulating balls creates ball-accepting spaces in the circulating volume. As new balls enter the circulating mass, the race of circulation decreases until movement near the discharge end 20*a*** approaches zero, blocking the further introduction of balls.

In addition to the correct position of the discharge end **20*a*, the effectiveness of the self-regulating phenomena also appears to be dependent upon the height of balls 18** in the receptacle cavity. The above-described ball height of the balls was measured after the balls had been permitted to circulate for several minutes. The jet was then deactivated and the measurement made.

Owing to the self-regulating feature of the described receptacle, it is possible to provide a very compact design which can tolerate the consequential rapid erosion of the circulating balls 18. Because of the self-regulating replenishment feature, the cutting operation need not be interrupted to replenish the balls.

While the receptacle 10 can be mounted so that its top and bottom surfaces are essentially horizontal, it may be desirable to tilt the receptacle from that orientation for a number of reasons. For example, the axial direction of the fluid jet may need to be non-horizontal. Additionally, it may be desirable for any unspent portion of the fluid jet to strike different portions of the carbide wearplate 22 over the life of the receptacle 10. It has been found in practice that the illustrated receptacle may be tilted 30 degrees from the horizontal without affecting the automatic replenishment feature described above. Beyond 30 degrees, the circulation of the balls appears to affected and the replenishment feature becomes less reliable.

FIG. 3 illustrates another embodiment of the invention wherein a receptacle having an automatic replenishment feature is adapted to receive a generally vertical fluid jet. The illustrated receptacle 50 comprises a stainless steel cylinder having an internal diameter of 11.4 cm (4.5 inches) and a height of 16.5 cm (6.5 inches). The inlet tube 52 extends from the cylinder at a 30–45 degree angle, with its center line intersecting the cylinder 3.8 cm (1.5 inches) from the cylinder top.

The discharge end 52*a* of the tube 52 is preferably cut at 90 degrees to the tube axis so that the discharge end is oblique to the axis of the cylinder 50. The volume of circulating balls is filled to a level just above the top edge 54 of the discharge end 52. The bottom edge 55 of the discharge end 52*a* is flushed with the inside wall of the cylinder 50.

An outlet conduit 56 extends from the bottom of the cylinder 50 to permit the egress of accumulating fluid from the spent fluid jet.

It has been found that the level of the balls in both embodiments is important to the proper functioning of the receptacle. If the level of the balls is too high, the balls will not rotate and will permit the jet to eventually penetrate the balls lying in the jet path. Conversely, if the level is too low, the balls will simply scatter, allowing the jet to pass between them.

If the discharge end of the inlet tube is placed at the correct level within the receptacle, the correct level of balls can be maintained indefinitely, regardless of the overall height of the inlet tube.

While the foregoing description includes detailed information which will enable those skilled in the art to practice the invention, it should be recognized the description is illustrative in that many modifications and variations will be apparent to those skilled in the art having the benefit of these teachings. It is accordingly intended that the invention herein be defined solely by the claims appended hereto and that the claims be interpretted as broadly as permitted in light of the prior art.

We claim:

1. An energy dissipating receptacle for receiving a high-velocity jet of fluid comprising (a) a body having an internal cavity and an aperture for receiving a high-velocity jet of fluid;

(b) a volume of suspensoids within the cavity (c) means for permitting the egress of dissipated fluid and suspensoid waste from the cavity while retaining the suspensoids therein;

(d) means for automatically maintaining an effective volume of suspensoids in the cavity as suspensoids are worn by impingement of the fluid jet.

2. The receptacle of claim 1 wherein the maintaining means includes an inlet tube having a discharge end extending into the suspensoid volume at a position wherein an insufficient suspensoid volume creates one or more suspensoid accommodating spaces in the circulating volume.

3. The receptacle of claim 2 means for orienting the receptacle so that the jet-receiving aperture is positioned to receive a fluid jet extending along an axis 30 degrees from the horizontal.

4. The receptacle of claim 3 wherein the aperture has a slotted shape to accommodate deflection of the jet as it passes through a workpiece.

5. The receptacle of claim 2 wherein the suspensoids comprise generally spherical members having a cross-section of approximately ¼ inch.

6. The receptacle of claim 5 wherein the tube has an approximately 1 inch cross section.

7. The receptacle of claim 2 wherein the suspensoids are formed from steel.

8. The receptacle of claim 2 including the tube has an approximately 1 inch cross section.

9. The receptacle of claim 1 wherein the suspensoids comprise generally spherical members having a cross-section of approximately ¼ inch.

10. The receptacle of claim 1 including an expendable surface member separated from the aperture by a section of the suspensoid volume and positioned for impact by an undissipated stream of fluid jet.

11. In a fluid jet cutting operation, a method for dissipating the energy of the fluid jet is a compact receptacle comprising the steps of (a) providing a jet-receiving aperture in one side of a compact receptacle, (b) substantially filling the cavity of the receptacle with suspensoids which circulate in the cavity as in the jet enters the aperture.

(c) draining off the dissipated fluid from in the cavity; and (d) feeding suspensoids into the receptacle during the cutting operation to maintain an effective suspensoid volume as suspensoids in the receptacle are consumed.

* * * * *